US010920784B2

(12) United States Patent
Lin et al.

(10) Patent No.: US 10,920,784 B2
(45) Date of Patent: Feb. 16, 2021

(54) MAGNETIC BEARING CENTRIFUGAL COMPRESSOR AND CONTROLLING METHOD THEREOF

(71) Applicant: INDUSTRIAL TECHNOLOGY RESEARCH INSTITUTE, Hsin-Chu (TW)

(72) Inventors: Jun-Jie Lin, Yilan County (TW); Jenn-Chyi Chung, Changhua County (TW); Chung-Che Liu, Hsinchu (TW); Kuo-Shu Hung, Hsinchu (TW)

(73) Assignee: INDUSTRIAL TECHNOLOGY RESEARCH INSTITUTE, Hsin-Chu (TW)

( * ) Notice: Subject to any disclaimer, the term of this patent is extended or adjusted under 35 U.S.C. 154(b) by 153 days.

(21) Appl. No.: 16/293,839

(22) Filed: Mar. 6, 2019

(65) Prior Publication Data

US 2020/0149540 A1 May 14, 2020

(30) Foreign Application Priority Data

Nov. 14, 2018 (TW) ..... 10714036.3

(51) Int. Cl.
*F04D 29/051* (2006.01)
*F25B 1/04* (2006.01)
*F04D 29/10* (2006.01)

(52) U.S. Cl.
CPC ..... *F04D 29/051* (2013.01); *F04D 29/10* (2013.01); *F25B 1/04* (2013.01); *F05D 2240/51* (2013.01)

(58) Field of Classification Search
CPC ..... F04D 29/051; F04D 29/10; F04D 29/052; F04D 29/0516; F04D 29/058;
(Continued)

(56) References Cited

U.S. PATENT DOCUMENTS 4,997,340 A 3/1991 Zinsmeyer et al.
5,345,127 A * 9/1994 New ..... F16C 32/0402 310/90.5
(Continued)

FOREIGN PATENT DOCUMENTS

CN 101297118 A 10/2008
CN 104121225 A 10/2014
(Continued)

OTHER PUBLICATIONS

Taiwan Patent Office, "Office Action", dated Mar. 17, 2020, Taiwan.
China Patent Office "Office Action", dated Aug. 27, 2020, China.

*Primary Examiner* — David E Sosnowski
*Assistant Examiner* — Danielle M. Christensen
(74) *Attorney, Agent, or Firm* — Locke Lord LLP; Tim Tingkang Xia, Esq.

(57) ABSTRACT

A magnetic bearing centrifugal compressor includes a magnetic bearing spindle having a thrust disk, front and rear axial bearings, an impeller and at least one labyrinth seal. The front and the rear axial bearings are disposed individually to opposing sides of the thrust disk. First and second clearances exist axially between the rear and front axial bearings, respectively, and the thrust disk. The impeller connects a front end of the magnetic bearing spindle. The labyrinth seal pairs the magnetic bearing spindle into an oblique arrangement with respect to the axial direction, and each the labyrinth seal is spaced from the magnetic bearing spindle or the impeller by a labyrinth-seal clearance. By controlling the thrust disk axially, a clearance ratio of the first clearance to the second clearance can be varied to adjust the labyrinth-seal clearance. In addition, a magnetic bearing centrifugal compressor controlling method is also provided.

15 Claims, 9 Drawing Sheets

(58) Field of Classification Search
CPC ..... F04D 29/053; F04D 29/056; F04D 29/04; F04D 29/048; F04D 29/041; F04D 29/042; F04D 29/08; F04D 29/162; F04D 27/00; F04D 17/00; F05D 2240/51; F05D 2240/511; F05D 2240/515; F05D 2240/52; F25B 1/04
See application file for complete search history.

(56) References Cited

U.S. PATENT DOCUMENTS

| | | | | |
|---|---|---|---|---|
| 7,240,515 | B2 | 7/2007 | Conry | |
| 2007/0063449 | A1* | 3/2007 | Muller | F04D 29/284 277/411 |
| 2007/0065317 | A1* | 3/2007 | Stock | F04D 29/584 417/423.11 |
| 2009/0009017 | A1 | 1/2009 | Miyagawa et al. | |
| 2009/0127956 | A1* | 5/2009 | Ozaki | F16C 25/08 310/90.5 |
| 2016/0273324 | A1 | 9/2016 | Yamaguchi et al. | |
| 2018/0023584 | A1 | 1/2018 | Morgan et al. | |

FOREIGN PATENT DOCUMENTS

| | | | | | |
|---|---|---|---|---|---|
| CN | 104508305 | B | | 8/2017 | |
| CN | 207568890 | U | | 7/2018 | |
| EP | 3358146 | A1 | | 8/2018 | |
| EP | 2252804 | B1 | | 10/2018 | |
| JP | 57079295 | A | * | 5/1982 | F04D 29/0516 |
| JP | S61171968 | A | | 8/1986 | |
| JP | 2007162725 | A | | 6/2007 | |
| JP | 2016166536 | A | | 9/2016 | |
| TW | I315382 | B | | 10/2009 | |
| TW | 201317468 | A | | 5/2013 | |
| TW | M513933 | U | | 12/2015 | |
| TW | 201634816 | A | | 10/2016 | |
| TW | 201708710 | A | | 3/2017 | |
| WO | 2018111457 | A1 | | 6/2018 | |

* cited by examiner

MAGNETIC BEARING CENTRIFUGAL COMPRESSOR AND CONTROLLING METHOD THEREOF

CROSS REFERENCE TO RELATED APPLICATION

This application claims the benefits of Taiwan application Serial No. 107140363, filed on Nov. 14, 2018, the disclosures of which are incorporated by references herein in its entirety.

TECHNICAL FIELD

The present disclosure relates in general to a magnetic bearing centrifugal compressor and a controlling method thereof.

BACKGROUND

The centrifugal compressor is a compressor whose impeller works on the gas so as to boost the gas pressure and thus accelerate the gas, such that the gas can be rapidly transported to pass the impeller. After the impeller rotates in a high speed to induce a centrifugal force to drive the interior gas out to the diffuser in a later section of the compressor, the impeller would then become vacuumed (lower pressure) so as able to suck in the foreign fresh gas automatically into the compressor. With the impeller to keep rotating, the gas would flow in and out of the compressor continuously.

Recently, in order to fulfill high-speed rotation, a magnetic bearing is implemented to rotationally support a spindle of the centrifugal compressor without direct contact, so that no frictional heat would be generated in between. Thereupon, the spindle can thus rotate fast.

In the art, to prevent invalid compression and further energy waste from possible gas leak, a labyrinth seal can be introduced to adjust the gas leakage. However, since clearances of the labyrinth seal are constant and unable to be adjusted, thus the gas leakage would become larger as the clearance of the labyrinth seal grows big. In order to obtain better protection against gas leak and improved efficiency of the compressor, the clearance of the labyrinth seal needs to be minimized. However, such a resort would raise the requirement in machining precision and increase the difficulties in manufacturing. In addition, the assembly of the compressor would become inconvenient, and the production cost would be increased as well. Further, it is well known that the gas leakage is reversely proportional to the axial thrust. In other words, as the clearance of the labyrinth seal becomes smaller, the gas leakage would be less, so that the axial thrust would go larger. On the other hand, as the clearance of the labyrinth seal becomes larger, the gas leakage would be more, so that the axial thrust would be less. However, since the clearance of the labyrinth is hard to be adjusted, the associated gas leakage and the axial thrust would be less controllable.

Accordingly, it is urgent and welcome to the art to provide an improved magnetic bearing centrifugal compressor and a controlling method thereof that can overcome the aforesaid shortcomings.

SUMMARY

An object of the present disclosure is to provide a magnetic bearing centrifugal compressor that can adjust the clearance of the labyrinth seal by varying the structural arrangement. Thereupon, the associated gas leakage and axial thrust can be controllable.

Another object of the present disclosure is to provide a method for controlling a magnetic bearing centrifugal compressor that can adjust the clearance of the labyrinth seal to further control the gas leakage and the axial thrust.

In this disclosure, the magnetic bearing centrifugal compressor includes a magnetic bearing spindle, a thrust disk, a front axial bearing and a rear axial bearing, an impeller and at least one labyrinth seal. The magnetic bearing spindle, movable in an axial direction, includes an axial thrust-reducing ring. The thrust disk sleeves fixedly the magnetic bearing spindle in a radial direction. The front axial bearing and the rear axial bearing are disposed individually to two opposing sides of the thrust disk. Further, a first clearance exists between the rear axial bearing and the thrust disk in the axial direction, and a second clearance exists between the front axial bearing and the thrust disk in the axial direction. The impeller is connected to a front end of the magnetic bearing spindle. The at least one labyrinth seal pairs the magnetic bearing spindle into an oblique arrangement with respect to the axial direction, and each of the at least one labyrinth seal is spaced from the magnetic bearing spindle or the impeller by a labyrinth-seal clearance. By controlling a position of the thrust disk in the axial direction, a clearance ratio of the first clearance to the second clearance can be varied to adjust the labyrinth-seal clearance.

In this disclosure, the method for controlling a magnetic bearing centrifugal compressor includes the steps of: (a) providing the magnetic bearing centrifugal compressor, (b) determining whether or not an axial thrust of the magnetic bearing spindle is within an allowable range, and (c) controlling a position of the thrust disk in the axial direction to adjust the labyrinth-seal clearance.

As stated, by providing the magnetic bearing centrifugal compressor and the controlling method thereof in this disclosure, the labyrinth seals and the corresponding magnetic bearing spindle and impeller, respectively, are paired into oblique arrangements in the axial direction, such that, through controlling the position of the thrust disk in the axial direction to adjust the labyrinth-seal clearances. Thereupon, the axial thrust can be adjusted, and the gas leakage can be controlled.

Further, the teeth portion of the conventional labyrinth seal is mainly a horizontal structure. Namely, the teeth portion of the labyrinth seal is parallel to the axial direction. In production, the conventional labyrinth seal is machined in the radial direction to form the horizontal teeth portion by appropriate machine tools. Generally speaking, the aforesaid manufacturing is comparatively difficult. Especially, if the clearance of the labyrinth ring for the conventional horizontal structure is demanded to be smaller, then the associated machining precision shall be increased, and the manufacturing difficulty would become much more severe. In addition, possibility of assembly interference or abnormal element contacts would be increased. Thereupon, it is inevitable that the assembling would be less easy, and the production cost would be raised. Further, at this time, the familiarity of technicians for assembling would be crucial. In comparison with the conventional horizontal structure for the teeth portion of the labyrinth seal (i.e., the teeth portion of the labyrinth seal is parallel to the axial direction), the teeth portion of the labyrinth seal in this embodiment is a tapered structure (i.e., the teeth portion of the labyrinth seal is not parallel to the axial direction), so that difficulties in both manufacturing and assembling the labyrinth seals can be reduced.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
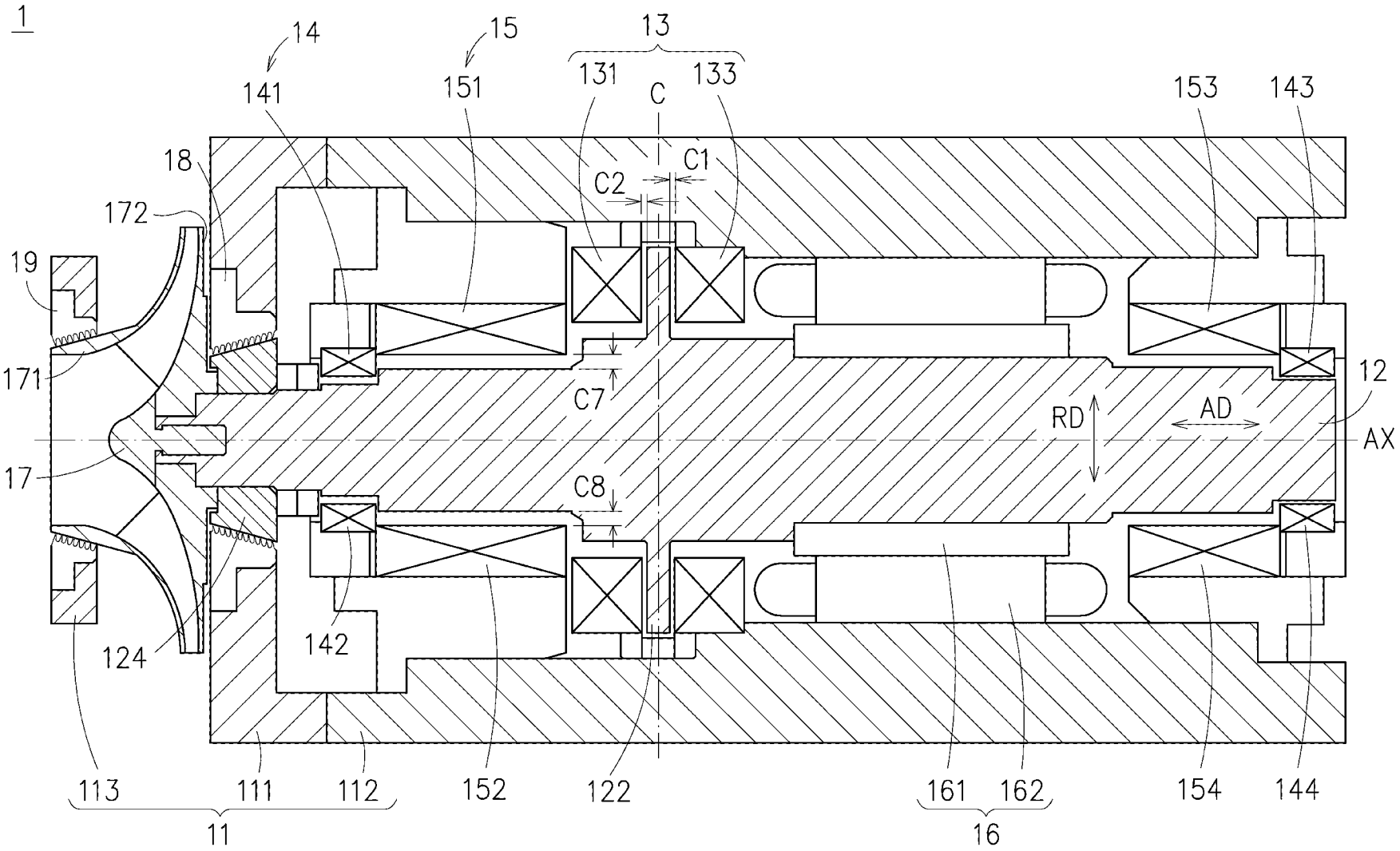
FIG. 1 is a schematic cross-sectional view of an embodiment of the magnetic bearing centrifugal compressor in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
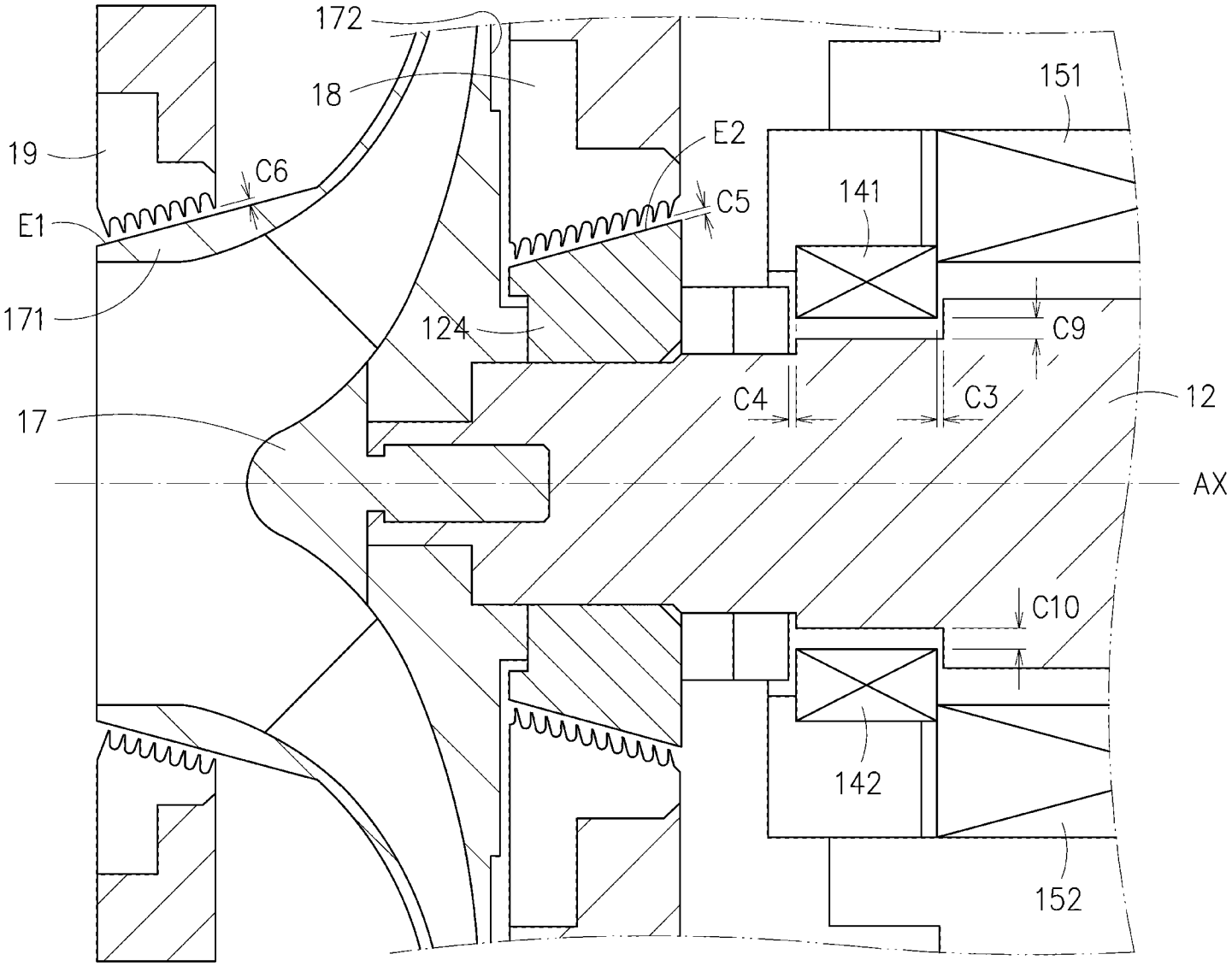
FIG. 2 is an enlarged view of a portion of FIG. 1, including the impeller, the magnetic bearing spindle and the touchdown bearing.

Refer now to FIG. 1 and FIG. 2; where FIG. 1 is a schematic cross-sectional view of an embodiment of the magnetic bearing centrifugal compressor in accordance with this disclosure and FIG. 2 is an enlarged view of a portion of FIG. 1 including the impeller, the magnetic bearing spindle and the touchdown bearing. As shown, the magnetic bearing centrifugal compressor 1 includes a casing 11, a magnetic bearing spindle 12, a thrust disk 122, an axial bearing assembly 13, a touchdown bearing assembly 14, a radial bearing 15, a driving device 16, an impeller 17 and at least one labyrinth seal (two 18, 19 shown in the figure).

In this disclosure, by having FIG. 1 as an exemplary example, the magnetic bearing spindle 12 in the casing 11 is formed as a shaft body extending in an axial direction AD. In particular, the magnetic bearing spindle 12 is movably disposed in a first casing 111 and a second casing 112 connected with the first casing 111. The impeller 17 is rotationally connected to a front end of the magnetic bearing spindle 12. The driving device 16 includes a motor rotor 161 and a motor stator 162 pairing, without contacting, the motor rotor 161, in which the motor rotor 161 and the motor stator 162 are both arranged to circle the magnetic bearing spindle 12. The motor rotor 161 is fixed and thus moved synchronously with the magnetic bearing spindle 12, and the motor stator 162 is mounted fixedly to an inner wall of the casing 11 (precisely, the second casing 112). The motor stator 162 of the driving device 16 is energized properly for producing predetermined electromagnetic forcing to drive the motor rotor 161 and so the magnetic bearing spindle 12 as well. Namely, the magnetic bearing spindle 12 is located in the casing 11 but spaced from the inner wall of the casing 11 by predetermined spacing. Also, the motor rotor 161 driven by the motor stator 162 is to rotate and drive the magnetic bearing spindle 12 synchronously, such that the magnetic bearing spindle 12 can rotate and displace in the axial direction AD so as further to drive the impeller 17. The gas can enter the compressor 1 via an inlet 171 of the impeller 17. While the impeller 17 is rotated, a centrifugal force would be applied to the gas around the impeller 17, such that the gas can be compressed. The magnetic bearing spindle 12 includes an axial thrust-reducing ring 124 sleeving the front portion of the magnetic bearing spindle 12 by being adjacent to a back-plane portion 172 of the impeller 17, so that the axial thrust-reducing ring 124 can be used to reduce the cross-sectional area for sustaining pressures from the back-plane portion 172 of the impeller 17, and such that the axial thrust can be reduced. In this disclosure, the axial thrust-reducing ring 124 can be a separate part that is mounted onto the magnetic bearing spindle 12, or can be simply a protrusion of the magnetic bearing spindle 12. It shall be also explained that the term "axial direction" herein stands for the centerline direction of the object. By having FIG. 1 as an exemplary example, the magnetic bearing spindle 12 rotates about a centerline AX. In addition, the term "radial direction" herein stands for a direction perpendicular to the central axle. By having FIG. 1 as an exemplary example, the centerline AX is the extending direction of the central axle, i.e., the magnetic bearing spindle 12. Thus, the radial direction RD of the magnetic bearing spindle 12 stands for the direction perpendicular to the centerline AX of the magnetic bearing spindle 12.

In this embodiment, the thrust disk 122 disposed inside the second casing 112 of the casing 11 by sleeving and contacting the magnetic bearing spindle 12 is formed as a disk extending radially in the radial direction RD. Preferably, the thrust disk 122 and the magnetic bearing spindle 12 are integrated as a single piece. The axial bearing assembly 13 disposed in the second casing 112 of the casing 11 by sleeving the magnetic bearing spindle 12 without direct contact is consisted of a front axial bearing 131 and a rear axial bearing 133, where the front axial bearing 131 and the rear axial bearing 133 are furnished to opposing sides (rear end front) of the thrust disk 122. As shown in the axial direction AD of FIG. 1, a first clearance C1 exists between the rear axial bearing 133 and the thrust disk 122, and a second clearance C2 exists between the front axial bearing 131 and the thrust disk 122. By having FIG. 1 as an exemplary example, the thrust disk 122 is preferably disposed in a middle position C of the front axial bearing 131 and the rear axial bearing 133 so as to maintain a clearance ratio of the first clearance C1 to the second clearance C2 to be 1, i.e., C1=C2. In this embodiment, by having the front axial bearing 131 and the rear axial bearing 133 to sandwich the thrust disk 122, possible push in the axial direction AD upon the impeller of the magnetic bearing centrifugal compressor 1 can be overcome.

In this embodiment of FIG. 1, the radial bearing assembly 15 disposed inside the second casing 112 of the casing 11 by sleeving the magnetic bearing spindle 12 without direct contact is consisted of a front radial bearing 151 (note that the label 152 is used to indicate a part of the same bearing 151 shown in another side of the magnetic bearing spindle 12) and a rear radial bearing 153 (note that the label 154 is used to indicate a part of the same bearing 153 shown in another side of the magnetic bearing spindle 12), where the front radial bearing 151 is located in front of the thrust disk 122 and the front axial bearing 131, and the rear radial bearing 153 is located posterior to the thrust disk 122 and the rear axial bearing 133. In this embodiment, a first radial-bearing clearance C7 exists in the radial direction RD between the front radial bearing 151 (shown in an upper side of the magnetic bearing spindle 12 in the figure) and the magnetic bearing spindle 12, and a second radial-bearing clearance C8 exists in the radial direction RD between the front radial bearing 152 (shown in a lower side of the magnetic bearing spindle 12 in the figure) and the magnetic bearing spindle 12. Similarly, a radial-bearing clearance (preferably, equal to the first radial-bearing clearance C7) exists in the radial direction RD between the upper-side rear radial bearing 153 and the magnetic bearing spindle 12, and a radial-bearing clearance (preferably, equal to the second radial-bearing clearance C8) exists in the radial direction RD between the lower-side rear radial bearing 154 and the magnetic bearing spindle 12.

In this embodiment, the touchdown bearing assembly 14 is disposed inside the casing 11 by sleeving the magnetic bearing spindle 12 without direct contact. By having FIG. 1 as an exemplary example, the front radial bearing 151 are located between the touchdown bearing assembly 14 and the thrust disk 122. The touchdown bearing 14 includes a front touchdown bearing 141 (note that the label 142 is used to indicate a part of the same bearing 141 shown in another side of the magnetic bearing spindle 12) and a rear touchdown bearing 143 (note that the label 144 is used to indicate a part of the same bearing 143 shown in another side of the magnetic bearing spindle 12). The front touchdown bearing 141 is located in front to the thrust disk 122, while the rear touchdown bearing 143 is located posterior to the thrust disk 122. In this embodiment, the front touchdown bearing 141 is located in the upper side of the magnetic bearing spindle 12, and a third touchdown-bearing clearance C9 exists in the radial direction RD between the upper-side front touchdown bearing 141 and the magnetic bearing spindle 12. In addition, a first touchdown-bearing clearance C3 and a second touchdown-bearing clearance C4 exist to opposing sides of the front touchdown bearing 141 in the axial direction AD. On the other hand, a fourth touchdown-bearing clearance C10 exists in the radial direction RD between the lower-side front touchdown bearing 142 and the magnetic bearing spindle 12. Definitely, the first touchdown-bearing clearance C3 and the second touchdown-bearing clearance C4 exist to opposing sides of the front touchdown bearing 142 in the axial direction AD shown in the figure. The touchdown-bearing clearance in the radial direction RD between the upper-side rear touchdown bearing 143 and the magnetic bearing spindle 12 is equal to the third touchdown-bearing clearance C9, and the touchdown-bearing clearance in the radial direction RD between the lower-side rear touchdown bearing 144 and the magnetic bearing spindle 12 is equal to the fourth touchdown-bearing clearance C10.

Upon such an arrangement, the magnetic bearing spindle 12 can shift in the axial direction AD, and can rotate about the centerline AX. The first clearance C1 is larger than the first touchdown-bearing clearance C3, the first clearance C1 is larger than the second touchdown-bearing clearance C4, the second clearance C2 is larger than the first touchdown-bearing clearance C3, and the second clearance C2 is larger than the second touchdown-bearing clearance C4, such that the magnetic bearing spindle 12 can shift in the axial direction AD. With both the first clearance C1 and the second clearance C2 are larger than the clearance in the axial direction AD between the touchdown bearing assembly 14 and the magnetic bearing spindle 12. Namely, both the first touchdown-bearing clearance C3 and the second touchdown-bearing clearance C4 are smaller than the first clearance C1 or the second clearance C2. Thereupon, in the case that the magnetic bearing spindle 12 touches down, the touchdown bearing assembly 14 would sustain the magnetic bearing spindle 12, without damaging the front axial bearing 131 and the rear axial bearing 133. Namely, by providing the compressor 1 of this disclosure, the only component to be replaced during the maintenance is the touchdown bearing 141~144, which can protect the corresponding front axial bearing 131 and rear axial bearing 133.

On the other hand, the first radial-bearing clearance C7 is larger than the third touchdown-bearing clearance C9, the first radial-bearing clearance C7 is larger than the fourth touchdown-bearing clearance C10, the second radial-bearing clearance C8 is larger than third touchdown-bearing clearance C9, and the second radial-bearing clearance C8 is larger than the fourth touchdown-bearing clearance 10, such that the magnetic bearing spindle 12 can displace in the radial direction RD. Each of the aforesaid first radial-bearing clearance C7 or the second radial-bearing clearance C8 is larger than the clearance of the touchdown bearing assembly 14 in the radial direction RD. Namely, each of the third touchdown-bearing clearance C9 and the fourth touchdown-bearing clearance C10 is smaller than any of the first radial-bearing clearance C7 and the second radial-bearing clearance C8. Thereupon, in the case that the magnetic bearing spindle 12 touches down, the touchdown bearing assembly 14 would sustain the magnetic bearing spindle 12, without damaging the front radial bearing 151 and the rear radial bearing 153. Namely, by providing the compressor 1 of this disclosure, the only component to be replaced during the maintenance is the touchdown bearing 141~144, which can protect the corresponding the front radial bearing 151 and the rear radial bearing 153.

In this embodiment, the labyrinth seal 19, fixed inside the third casing 113 of the casing 11, sleeves the inlet 171 of the impeller 17. The axial thrust-reducing ring 124 fixed to the magnetic bearing spindle 12 by sleeving is further sleeved by the labyrinth seal 18 that is fixed inside the third casing 112 of the casing 11. By providing these two labyrinth seals 18, 19, possible gas leak during the operation of the magnetic bearing centrifugal compressor 1 can be reduced. In some other embodiments, the labyrinth seal can be furnished only to the impeller 17 or the magnetic bearing spindle 12, but per practical requirements. In this embodiment, both of the two labyrinth seals 18, 19 are in angular mounting with respect to the axial direction AD. Namely, the contact area of each the labyrinth seal 18 or 19 and the magnetic bearing spindle 12 exhibit an oblique pair with respect to the axial direction AD. As shown in FIG. 2, a labyrinth-seal clearance C5 exists between the labyrinth seal 18 and the axial thrust-reducing ring 124 of the magnetic bearing spindle 12, and a labyrinth-seal clearance C6 exists between the labyrinth seal 19 and the impeller 17.

In detail, in this embodiment, upon when the labyrinth seal 18 is mounted to sleeve the axial thrust-reducing ring 124 of the magnetic bearing spindle 12, since an oblique surface E2 is provided by the axial thrust-reducing ring 124, a teeth portion (inner portion) of the labyrinth seal 18 are paired with the oblique surface E2 so as to exhibit an oblique arrangement in between. In particular, the labyrinth seal 18 is formed as a diverging structure while is viewed from the thrust disk 122. In other words, in the axial direction AD, by viewing the first casing 111 of the casing 11 from a front end to a rear end, the radial distance of the teeth portion of the labyrinth seal 18 to the centerline AX of the magnetic bearing spindle 12 grows bigger gradually. Namely, the teeth portion of the labyrinth seal 18 expands in a tapered manner.

As described above, the oblique surface E2 and the teeth portion of the labyrinth seal 18 are paired into a symmetric conical arrangement, and thus the oblique surface E2 exhibits a diverging structure while in viewing from the thrust disk 122; i.e., in the axial direction AD from the front end to the rear end of the first casing 111 of the casing 11. In such a viewing direction, the radial distance of the teeth portion of the labyrinth seal 18 to the centerline AX of the magnetic bearing spindle 12 grows bigger gradually.

On the other hand, upon when the labyrinth seal 19 is mounted to sleeve the impeller 17, since another oblique surface E1 is provided by the inlet 171 of the impeller 17, a teeth portion (inner portion) of the labyrinth seal 19 are paired with the oblique surface E1 so as to exhibit an oblique arrangement in between. In particular, the labyrinth seal 19 is formed as a diverging structure while is viewed from the thrust disk 122. In other words, in the axial direction AD from a front end to a rear end of the inlet 171 of the impeller 17, the radial distance of the teeth portion of the labyrinth seal 19 to the centerline AX of the magnetic bearing spindle 12 grows bigger gradually. The oblique surface E1 of the impeller 17 and the teeth portion of the labyrinth seal 19 are paired into a symmetric conical arrangement, and thus the oblique surface E1 exhibits a diverging structure while in viewing from the thrust disk 122; i.e., in the axial direction AD from the front end to the rear end of the inlet 171 of the impeller 17. In such a viewing direction, the radial distance of the teeth portion of the labyrinth seal 19 to the centerline AX of the magnetic bearing spindle 12 grows bigger gradually.

In the art, the teeth portion of the conventional labyrinth seal is mainly a horizontal structure. Namely, the teeth portion of the labyrinth seal is parallel to the axial direction AD. In production, the labyrinth seal is machined in the radial direction RD to form the horizontal teeth portion by appropriate machine tools. Generally speaking, the aforesaid manufacturing is comparatively difficult. Especially, if the clearance of the labyrinth seal for the conventional horizontal structure is demanded to be smaller, then the associated machining precision shall be increased, and the manufacturing difficulty would become much severe. In addition, possibility of assembly interference or abnormal element contacts would be increased. Thereupon, it is inevitable that the assembling would be less easy, and the production cost would be raised. Further, at this time, the familiarity of technicians for assembling would be critical. In comparison with the conventional horizontal structure for the teeth portion of the labyrinth seal (i.e., the teeth portion of the labyrinth seal parallel to the axial direction AD), the teeth portion of the labyrinth seal 18 or 19 in this embodiment is a tapered structure (i.e., the teeth portion of the labyrinth seal being not parallel to the axial direction AD), so that difficulties in both manufacturing and assembling the labyrinth seals can be reduced.

Figure 3A:
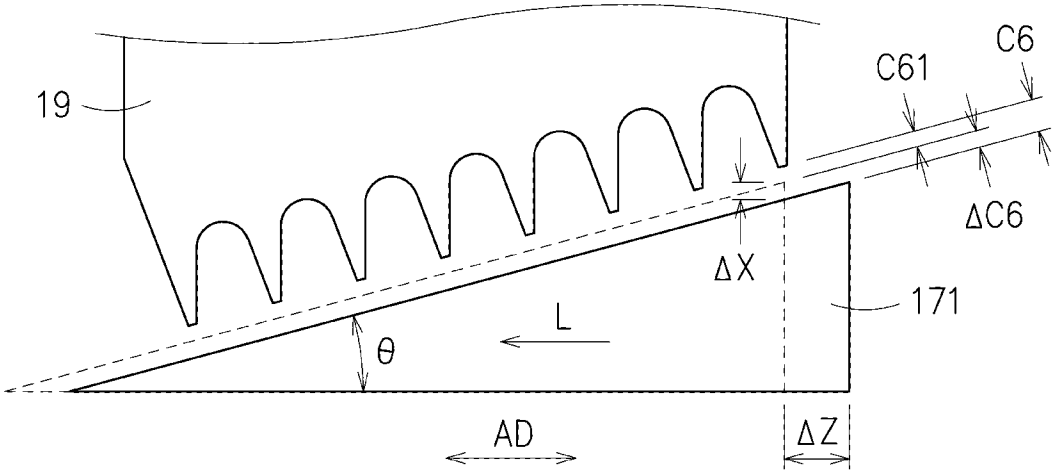
FIG. 3A is an enlarged view of another portion of FIG. 1, including the labyrinth seal, the impeller and the clearances of the labyrinth seal.
Figure 3B:
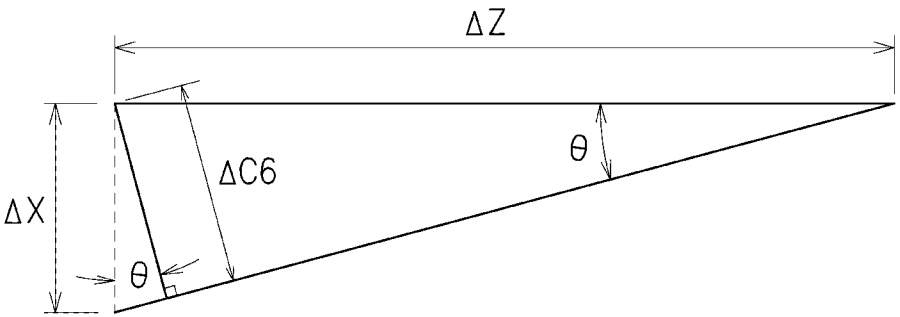
FIG. 3B demonstrates schematically a triangular relationship between the impeller and the clearances of the labyrinth seal of FIG. 3A.
Figure 3C:
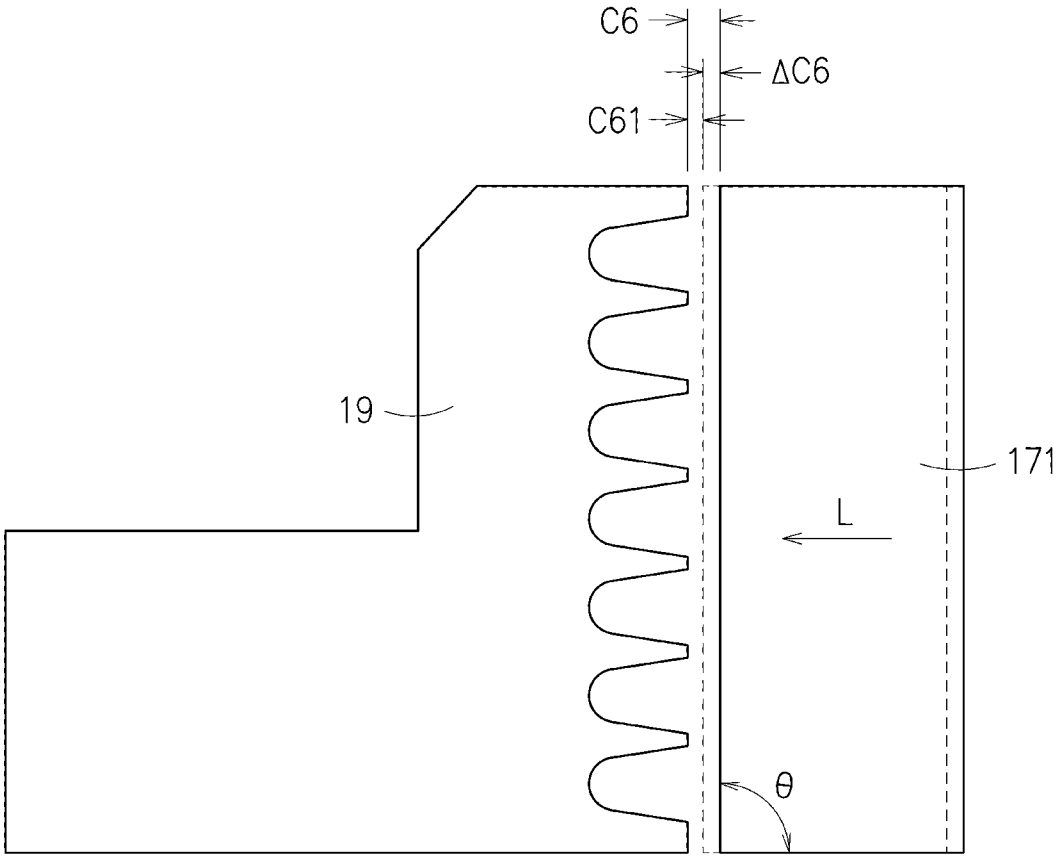
FIG. 3C is a schematic enlarged view of another embodiment of the labyrinth seal and the corresponding clearances of FIG. 1.

Refer now to FIG. 1, FIG. 2, and FIG. 3A through FIG. 3C; where FIG. 3A is an enlarged view of another portion of FIG. 1 (including the labyrinth seal, the impeller and the clearances of the labyrinth seal), FIG. 3B demonstrates schematically a triangular relationship between the impeller and the clearances of the labyrinth seal of FIG. 3A, and FIG. 3C is a schematic enlarged view of another embodiment of the labyrinth seal and the corresponding clearances of FIG. 1. In this embodiment, a labyrinth-seal clearance C6 exists between the oblique surface E1 at the inlet 171 of the impeller 17 and the labyrinth seal 19, an angle θ as shown is smaller than or equal to 90 degrees. In FIG. 1 to FIG. 3A, the angle θ is larger than 0 but smaller than 90 degrees. In FIG. 3C, the angle θ is equal to 90 degrees.

Upon the aforesaid arrangement, as shown in FIG. 1, the thrust disk 122 IC controlled to be positioned at the middle position C between the front axial bearing 131 and the rear axial bearing 133 by having the first clearance C1 to be equal to the second clearance C2; i.e., by making the clearance ratio of the first clearance C1 to the second clearance C2 equal to 1. Upon when the thrust disk 122 displaces forward from the middle position C, the magnetic bearing spindle 12 would be moved simultaneously toward the impeller 17 in the axial direction AD. Thus, the first clearance C1 would be larger than the second clearance C2 so as to make the clearance ratio of the first clearance C1 to the second clearance C2 greater than 1. At this time, the axial thrust-reducing ring 124 and the impeller 17 would move synchronously with the magnetic bearing spindle 12 in the axial direction AD so as to approach the oblique surfaces E2 and E1 of the labyrinth seals 18, 19, respectively. Namely, the labyrinth-seal clearance C6 between the inlet 171 of the impeller 17 and the labyrinth seal 19 would become smaller. As shown in FIG. 3A, the original labyrinth-seal clearance C6 would become a smaller labyrinth-seal clearance C61, after the inlet 171 of the impeller 17 moves toward the labyrinth seal 19 by a displacement ΔZ in a moving direction L parallel to the axial direction AD. The difference between C6 and C61 is denoted by ΔC6, and ΔC6=ΔZ·sin θ. If θ=90°, then ΔC6=ΔZ, as shown in FIG. 3C. Also, in this situation, the radial clearance difference ΔX=ΔZ·tan θ.

For example, if ΔZ=0.06 mm and θ=15°, then ΔC6=0.0155 mm. Namely, in the case that the impeller 17 moves in a moving direction L by a displacement ΔZ=0.06 mm, then the clearance difference ΔC6 would be 0.0155 mm. In this situation, if the original labyrinth-seal clearance C6 is 0.15 mm, then the new labyrinth-seal clearance C61 after the displacement ΔZ would become 0.1345 mm (C6−ΔC6).

In addition, while in calculating the gas leakage, equation (1) as follows can be applied.

$$Q \sim \rho \times C_v \times A \times (\Delta p)^{1/2} \quad (1)$$

In which Q is the quantity of gas leakage, p is the gas density, $C_v$ is the flow coefficient, A is the cross-sectional area of the labyrinth-seal clearance, and ΔP is the pressure drop across the labyrinth-seal clearance. The gas-leak equation (1) demonstrates that, if the pressure drop Δp is fixed, then the quantity of gas leakage Q would be proportional to the cross-sectional area A, in which the cross-sectional area A is related to the diameter and clearance of the labyrinth seal. By giving that the teeth number and diameter of the labyrinth seal to be constant, the cross-sectional area A would be proportional to the labyrinth-seal clearance. Namely, as the labyrinth-seal clearance becomes smaller, the cross-sectional area A would go smaller as well. On the other hand, if the labyrinth-seal clearance grows, the cross-sectional area A would become bigger. For instance, in the aforesaid example, the percentage of the clearance difference ΔC6 to the labyrinth-seal clearance C6 is 10.3%. In other words, by varying the position of the thrust disk 122 between the front axial bearing 131 and the rear axial bearing 132 to have the magnetic bearing spindle 12 to displace in the axial direction AD directing the impeller 17 (i.e., to have the first clearance C1 larger than the second clearance C2, and to make the clearance ratio of the first clearance C1 to the second clearance C2 larger than 1), then the labyrinth-seal clearance C6 would be reduced. In this example of the C6 to be reduced by 10.3%, the cross-sectional area of the labyrinth-seal clearance would be reduced by 10.3%. It implies that, while the magnetic bearing centrifugal compressor 1 is operated to reduce the gas leakage, say by 10.3%, then performance and efficiency of the magnetic bearing centrifugal compressor 1 would be substantially promoted.

Figure 4A:
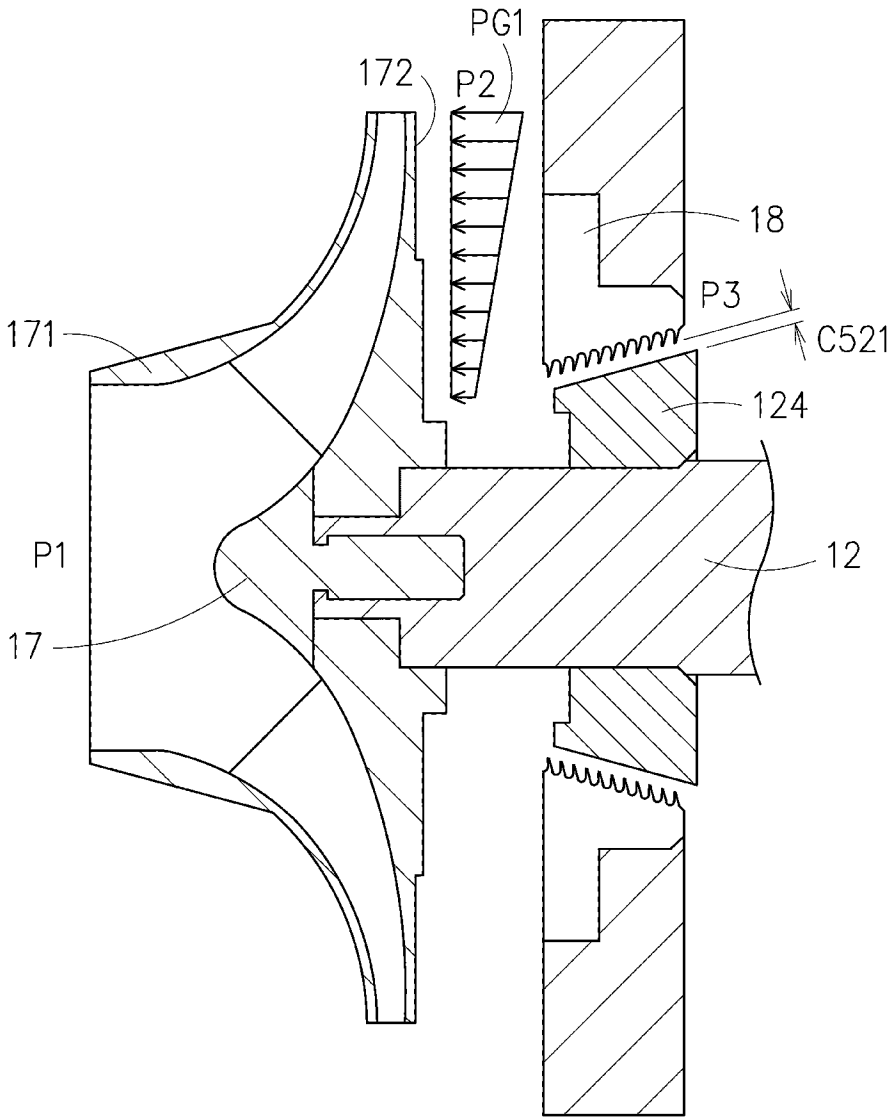
FIG. 4A is a schematic cross-sectional view of a portion of the magnetic bearing centrifugal compressor of FIG. 1 in motion.
Figure 4B:
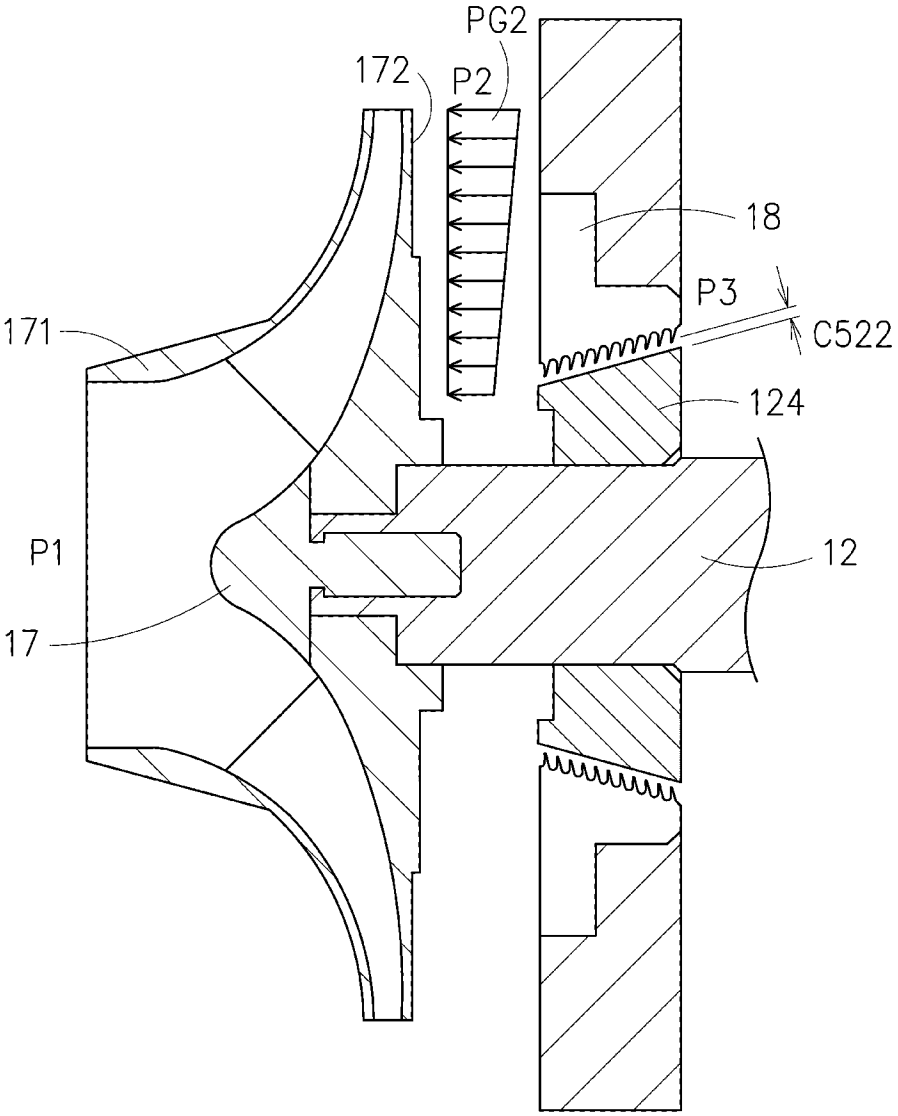
FIG. 4B shows another state of FIG. 4A.

As described above, in the magnetic bearing centrifugal compressor 1 provided by this disclosure, the labyrinth seals 18, 19 and the corresponding magnetic bearing spindle 12 and impeller 17, respectively, are paired into oblique arrangements in the axial direction AD, such that, through controlling the position of the thrust disk 122 in the axial direction AD to adjust the clearance ratio of the first clearance C1 to the second clearance C2, then the labyrinth-seal clearances C5, C6 can be varied to better control the gas leakage.

in this embodiment, the axial thrust can be also adjusted by varying the labyrinth-seal clearances C5, C6. Refer now to FIG. 4A and FIG. 4B; where FIG. 4A is a schematic cross-sectional view of a portion of the magnetic bearing centrifugal compressor of FIG. 1 in motion, and FIG. 4B shows another state of FIG. 4A. In this example, the inlet 171 of the impeller 17 has a first pressure P1, a back-plane portion 172 of the impeller 17 has a second pressure P2, and the labyrinth seal 18 has a third pressure P3, where P2>P1 and also P2>P3. Namely, the first pressure P1 and the third pressure P3 are both kept in relative low pressures with respect to the second pressure P2. The difference between FIG. 4A and FIG. 4B is that the labyrinth-seal clearance C521 of FIG. 4A is larger than the labyrinth-seal clearance C522 of FIG. 4B. Thereupon, a first-pressure gradient distribution PG1 on the back-plane portion 172 of the impeller 17 in FIG. 4A would be different to a second-pressure gradient distribution PG2 on the back-plane portion 172 of the impeller 17 in FIG. 4B. In addition, the axial thrust of the magnetic bearing spindle 12 can be obtained by equation (2) as follows:

$$F=P\times AF=\text{Integration}(PG)\times AF \quad (2)$$

in which F is the axial thrust F, P is the pressure on the back-plane portion 172 of the impeller 17, AF is the cross-sectional area for taking the pressure P, and PG is the pressure gradient distribution PG. Equation (2) says that, given the same cross-sectional area AF, the axial thrust F would be proportional to the pressure on the back-plane portion 172 of the impeller 17, and the pressure P on the back-plane portion 172 of the impeller 17 can be obtained by integrating the corresponding pressure gradient distribution PG. In other words, the axial thrust F is proportional to the pressure gradient distribution PG. Thus, in the case that the labyrinth-seal clearance C521 of FIG. 4A is larger than the labyrinth-seal clearance C522 of FIG. 4B, the axial first-pressure gradient distribution PG1 on the back-plane portion 172 of the impeller 17 in FIG. 4A is smaller than the axial second-pressure gradient distribution PG2 on the back-plane portion 172 of the impeller 17 in FIG. 4B, and the axial thrust would become smaller as well. On the other hand, in the case that the labyrinth-seal clearance C521 of FIG. 4A is smaller than the labyrinth-seal clearance C522 of FIG. 4B, the axial first-pressure gradient distribution PG1 on the back-plane portion 172 of the impeller 17 in FIG. 4A is larger than the axial second-pressure gradient distribution PG2 on the back-plane portion 172 of the impeller 17 in FIG. 4B, and the axial thrust would become larger as well. It shall be explained that, though FIG. 4A and FIG. 4B are discussing particularly the labyrinth seal 18 pairing the axial thrust-reducing ring 124, the same phenomena in pressures, clearances and axial thrust would occur to the labyrinth seal 19 pairing the impeller 17. Thus, details thereabout are omitted herein.

As described above, in the magnetic bearing centrifugal compressor 1 provided by this disclosure, the labyrinth seals 18, 19 and the corresponding magnetic bearing spindle 12 and impeller 17, respectively, are paired into oblique arrangements in the axial direction AD, such that, through controlling the position of the thrust disk 122 in the axial direction AD to adjust the clearance ratio of the first clearance C1 to the second clearance C2, then the labyrinth-seal clearances C5, C6 can be varied to better control the axial thrust as well as the gas leakage.

Figure 5:
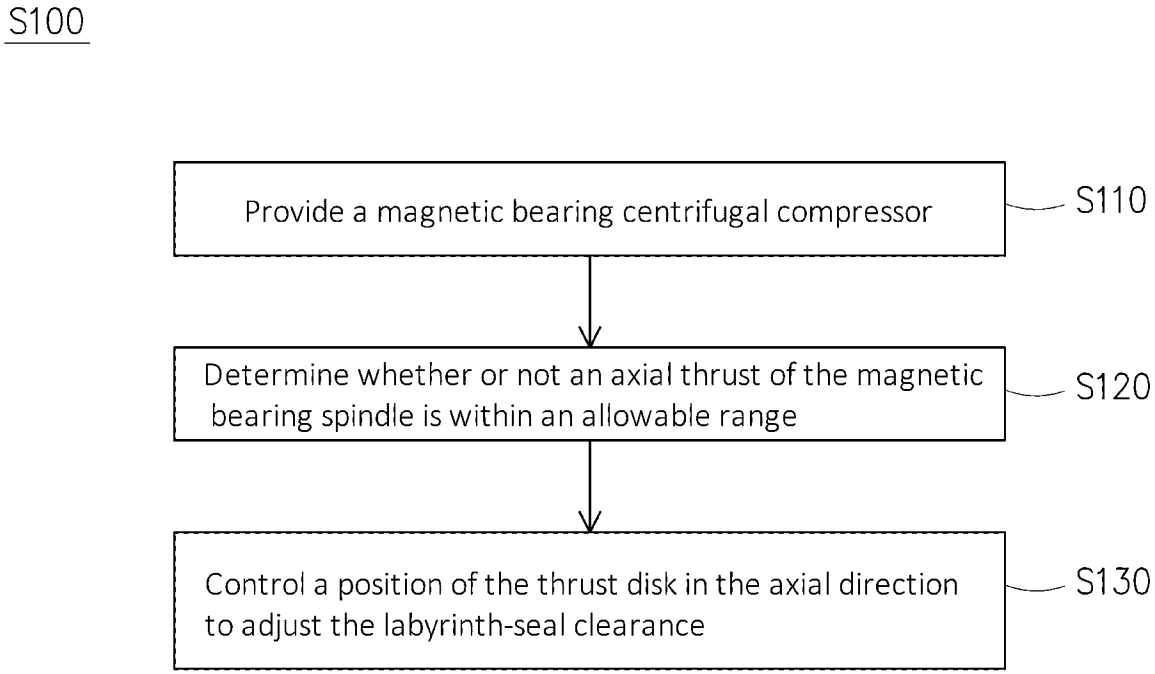
FIG. 5 demonstrates schematically an embodiment of the method for controlling a magnetic bearing centrifugal compressor in accordance with this disclosure.

Referring now to FIG. 5, an embodiment of the method for controlling a magnetic bearing centrifugal compressor in accordance with this disclosure is demonstrated schematically. As shown, the method for controlling a magnetic bearing centrifugal compressor S100 is applied to adjust axial thrust of a magnetic bearing spindle and to control gas leakage. Herein, the target magnetic bearing centrifugal compressor can be the magnetic bearing centrifugal compressor 1 of FIG. 1. In this embodiment, the method for controlling the magnetic bearing centrifugal compressor 1 of FIG. 1 S100 includes Step S110 to Step S130 as follows.

Firstly, in performing Step S110, the magnetic bearing centrifugal compressor 1 is provided, by referring to FIG. 1 to FIG. 4B. In particular, the labyrinth seals 18, 19 and the corresponding magnetic bearing spindle 12 and impeller 17, respectively, are paired into oblique arrangements in the axial direction AD. Labyrinth-seal clearances C5, C6 exist, respectively, between the labyrinth seal 18 and the axial thrust-reducing ring 124 of the magnetic bearing spindle 12, and between the labyrinth seal 19 and the impeller 17. In this embodiment, to monitor the axial thrust of the magnetic bearing spindle 12, the thrust disk 122 is initially set at the middle position C between the front axial bearing 131 and the rear axial bearing 133, such that the first clearance C1 is equal to the second clearance C2 (i.e., the clearance ratio of the first clearance C1 to the second clearance C2 is 1). In addition, some other parameters should be preset before performing the method of this disclosure. These parameters include an allowable axial thrust, a minimal value of the first touchdown-bearing clearance C3 and a minimal value of the second touchdown-bearing clearance C4.

In performing Step S120, detect and determine whether the axial thrust of the magnetic bearing spindle 12 is within the allowable axial thrust range; i.e., if the axial thrust of the magnetic bearing spindle 12 is an allowable axial thrust. In performing Step S130, the labyrinth-seal clearances C5, C6 are adjusted by displacing the thrust disk 122 in the axial direction AD, such that the axial thrust can be adjusted and the gas leakage can be controlled.

In one embodiment of the present disclosure, policies for adjusting the gas leakage of the labyrinth seal and for controlling the axial thrust are explained as follows. Supposed that the rated maximal axial thrust is 1500 N and the allowable axial thrust is 1000 N, then the 500 N overflow range is left for containing surges of the magnetic bearing centrifugal compressor 1. When the axial thrust of the magnetic bearing spindle 12 is detected to be less than 1000 N, then the thrust disk 122 is controlled to shift toward the impeller 17 in the axial direction AD, such that the first clearance C1 becomes larger than the second clearance C2 (i.e., the clearance ratio of the first clearance C1 to the second clearance C2 is larger than 1). At the same time, benefited from the oblique structuring in the labyrinth seals 18, 19 which is able to reduce the labyrinth-seal clearances C5, C6, the axial thrust can be increased, but the gas leakage can be reduced, such that the efficiency of the magnetic bearing centrifugal compressor 1 can be enhanced. On the other hand, if an axial thrust of the magnetic bearing spindle 12 is determined to be larger than 1000 N, then the thrust disk 122 can be controlled to displace in the axial direction AD away from the impeller 17, such that the first clearance C1 becomes smaller than the second clearance C2 (i.e., the clearance ratio of the first clearance C1 to the second clearance C2 is less than 1). At the same time, benefited from the oblique structuring in the labyrinth seals 18, 19 which is able to enlarge the labyrinth-seal clearances C5, C6, the axial thrust can be decreased, but the gas leakage can be increased, such that the magnetic bearing centrifugal compressor 1 can be protected.

Figure 6A:
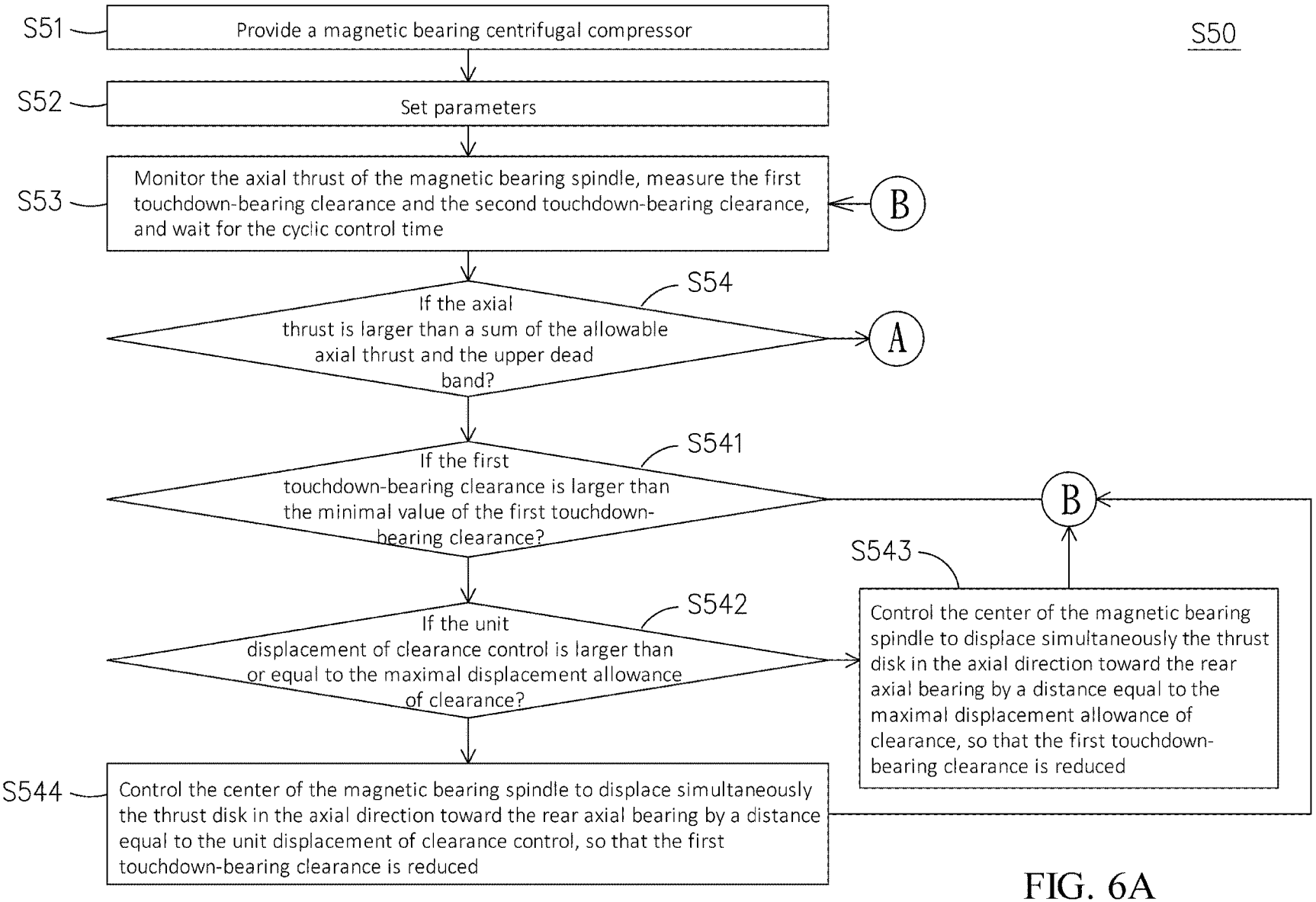
FIG. 6A and FIG. 6B show integrally and exemplary example for the embodiment of FIG. 5.
Figure 6B:
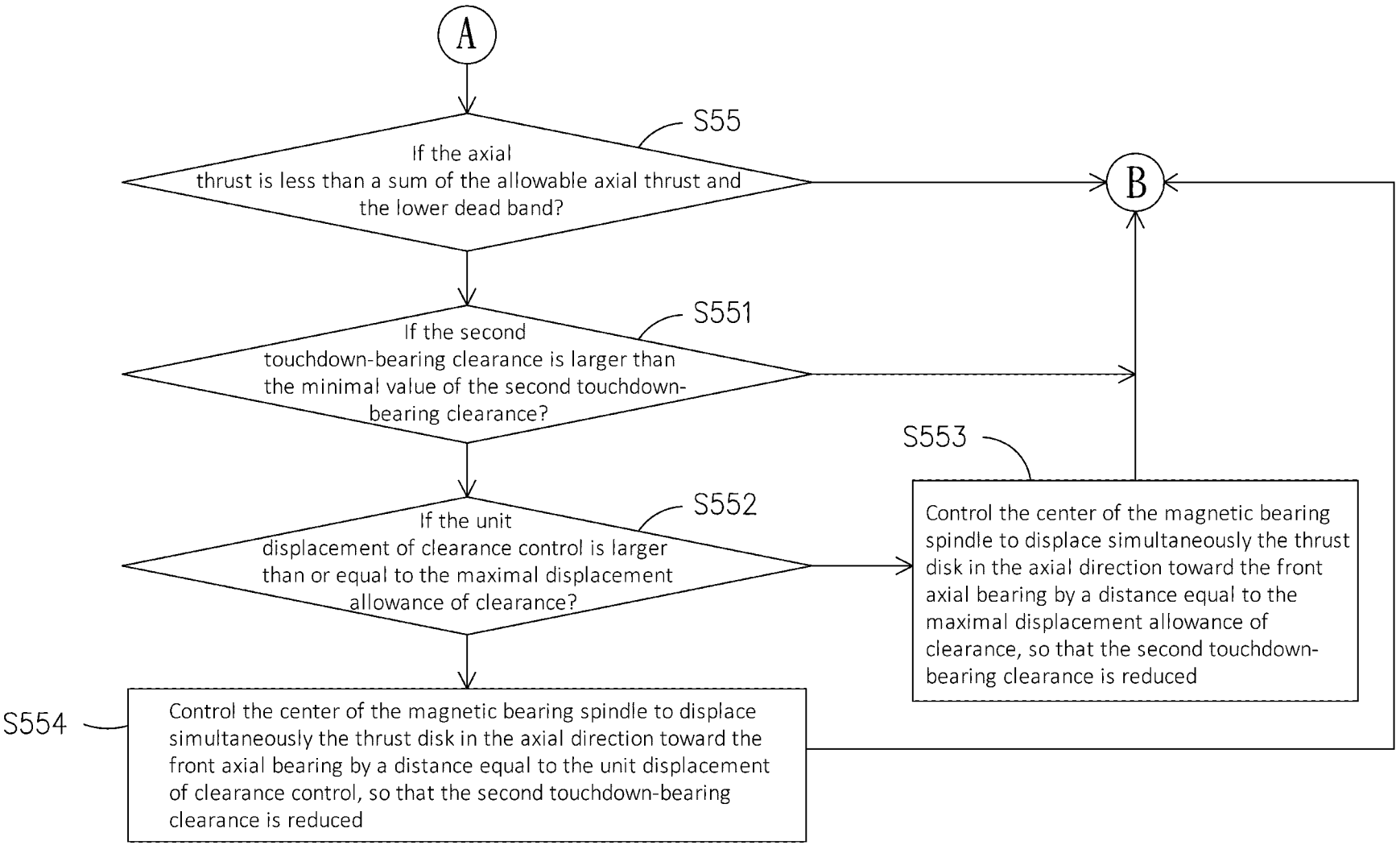

Referring now to FIG. 6A and FIG. 6B, an exemplary example for the embodiment of the method for controlling a magnetic bearing centrifugal compressor of FIG. 5 is shown integrally. In this exemplary example, the method for controlling a magnetic bearing centrifugal compressor S50 is used for adjusting the axial thrust of the magnetic bearing spindle and for controlling the gas leakage. Herein, the magnetic bearing centrifugal compressor 1 of FIG. 1 is applied. The method for controlling a magnetic bearing centrifugal compressor S50 includes Step S51 to Step S554 as follows.

Firstly, in performing Step S51, the magnetic bearing centrifugal compressor 1 referred to FIG. 1 through FIG. 4B is provided. In particular, the labyrinth seals 18, 19 and the corresponding magnetic bearing spindle 12 and impeller 17, respectively, are paired into oblique arrangements in the axial direction AD. Labyrinth-seal clearances C5, C6 exist, respectively, between the labyrinth seal 18 and the axial thrust-reducing ring 124 of the magnetic bearing spindle 12, and between the labyrinth seal 19 and the impeller 17. In this embodiment, to monitor the axial thrust of the magnetic bearing spindle 12, the thrust disk 122 is initially set at the middle position C between the front axial bearing 131 and the rear axial bearing 133, such that the first clearance C1 is equal to the second clearance C2 (i.e., the clearance ratio of the first clearance C1 to the second clearance C2 is 1).

Then, in performing Step S52, related parameters are set. These parameters can include an allowable axial thrust, a minimal value of the first touchdown-bearing clearance, a minimal value of the second touchdown-bearing clearance, a maximal displacement allowance of clearance, upper and lower dead bands of axial thrust, a unit displacement of clearance control, and a cyclic control time. The maximal displacement allowance of clearance is the maximal allowed displacement for the thrust disk 122. The unit displacement of clearance control is the displacement obtaining by multiplying a clearance-control percentage coefficient and each the clearance control. The cyclic control time is the periodical timing to control the magnetic bearing spindle 12. The upper and lower dead bands of axial thrust are rated maximal and minimal values of the axial thrust.

Then, in performing Step S53, the axial thrust of the magnetic bearing spindle 12 is detected, both the first touchdown-bearing clearance C3 and the second touchdown-bearing clearance C4 are measured, and the cyclic control time is waited to arrive.

Then, in performing Step S54, it is determined whether or not the detected axial thrust is larger than a sum of the allowable axial thrust and the upper dead band. If a judgment in Step S54 is positive, then go to perform Step S541 for determining whether or not the first touchdown-bearing clearance C3 is larger than the minimal value of the first touchdown-bearing clearance. If a judgment in Step S541 is negative, then it implies that the first touchdown-bearing clearance C3 detected in Step S53 is not larger than the minimal value of the first touchdown-bearing clearance. Further, as shown in FIG. 6A, go back to node B for performing Step S53 to keep monitoring the axial thrust of the magnetic bearing spindle 12, measuring the first touchdown-bearing clearance C3 and the second touchdown-bearing clearance C4, and waiting for the next cyclic control time.

If the judgment in Step S541 is positive, then it implies that the first touchdown-bearing clearance C3 detected in Step S53 is larger than the minimal value of the first touchdown-bearing clearance, and go to perform Step S542 for determining whether or not the unit displacement of clearance control is larger than or equal to the maximal displacement allowance of clearance. If a judgment in Step S542 is positive, thus the unit displacement of clearance control is larger than or equal to the maximal displacement allowance of clearance, and go to perform Step S543 for controlling a center of the magnetic bearing spindle 12 to displace simultaneously the thrust disk 122 in the axial direction AD toward the rear axial bearing 133 by a distance equal to the maximal displacement allowance of clearance, so that the first touchdown-bearing clearance C3 can be reduced. On the other hand, if the judgment in Step S542 is negative, thus the unit displacement of clearance control is less than the maximal displacement allowance of clearance, and go to perform Step S544 for controlling the center of the magnetic bearing spindle 12 to displace simultaneously the thrust disk 122 in the axial direction AD toward the rear axial bearing 133 by a distance equal to the unit displacement of clearance control, so that the first touchdown-bearing clearance C3 can be reduced. In other words, according to the judgment whether or not the unit displacement of clearance control exceeds the maximal displacement allowance of clearance, the target displacement of the thrust disk 122 can be decided. In addition, upon monitoring if the axial thrust of the magnetic bearing spindle 12 is larger than the sum of the allowable axial thrust and the upper dead band, the aforesaid Step S543 or Step S544 can be performed to control the thrust disk 122 to move away from the impeller 17 in the axial direction AD, such that the first clearance C1 is less than the second clearance C2 (i.e., the clearance ratio of the first clearance C1 to the second clearance C2 is less than 1). At the same time, benefited from the oblique structuring in the labyrinth seals 18, 19 which is able to enlarge the labyrinth-seal clearances C5, C6, the axial thrust can be decreased, but the gas leakage can be increased, such that the magnetic bearing centrifugal compressor 1 can be protected. Also, after the axial thrust has been reduced and the gas leakage has been increased by performing Step S543 or Step S544, as shown in FIG. 6A, the method goes back to node B for performing Step S53 to keep monitoring the axial thrust of the magnetic bearing spindle 12, measuring the first touchdown-bearing clearance C3 and the second touchdown-bearing clearance C4, and waiting for the next cyclic control time.

In the foregoing description upon monitoring if or not the axial thrust of the magnetic bearing spindle 12 is larger than the sum of the allowable axial thrust and the upper dead band, if the judgment in Step S54 is negative, it implies that the detected axial thrust of the magnetic bearing spindle 12 is not larger than the sum of the allowable axial thrust and the dead band, and then go to node A, i.e., connecting to FIG. 6B. In performing Step S55, determine whether or not the axial thrust is smaller than the sum of the allowable axial thrust and the lower dead band. If negative, it implies that the axial thrust is larger than the sum of the allowable axial thrust and the upper dead band, and also not smaller than the sum of the allowable axial thrust and the lower dead band. Namely, the axial thrust is within the allowable range (i.e., a safe monitoring range). Further, go back to node B. As shown in FIG. 6A, perform Step S53 to keep monitoring the axial thrust of the magnetic bearing spindle 12, measuring the first touchdown-bearing clearance C3 and the second touchdown-bearing clearance C4, and waiting for the next cyclic control time.

On the other hand, if the judgment in Step S55 is positive, it implies that the axial thrust is smaller than the sum of the allowable axial thrust and the lower dead band. In performing Step S551, determine whether or not the detected second touchdown-bearing clearance C4 is larger than the minimal second touchdown-bearing clearance. If a judgment in Step S551 is negative, it implies that the second touchdown-bearing clearance C4 detected in Step S53 is less than the minimal value of the second touchdown-bearing clearance. Further, go back to node B. As shown in FIG. 6A, perform Step S53 to keep monitoring the axial thrust of the magnetic bearing spindle 12, measuring the first touchdown-bearing clearance C3 and the second touchdown-bearing clearance C4, and waiting for the next cyclic control time.

If the judgment in Step S551 is positive, then perform Step S552 for determining whether or not the unit displacement of clearance control is larger than or equal to the maximal displacement allowance of clearance. If a judgment in Step S552 is positive, thus perform Step S553 for controlling the center of the magnetic bearing spindle 12 to displace simultaneously the thrust disk 122 in the axial direction AD toward the front axial bearing 131 by a distance equal to the maximal displacement allowance of clearance, so that the second touchdown-bearing clearance C4 can be reduced. On the other hand, if the judgment in Step S552 is negative, thus the unit displacement of clearance control is less than the maximal displacement allowance of clearance, and go to perform Step S554 for controlling the center of the magnetic bearing spindle 12 to displace simultaneously the thrust disk 122 in the axial direction AD toward the front axial bearing 131 by a distance equal to the unit displacement of clearance control, so that the second touchdown-bearing clearance C4 can be reduced. In other words, according to the judgment whether or not the unit displacement of clearance control exceeds the maximal displacement allowance of clearance, the target displacement of the thrust disk 122 can be decided. In addition, upon monitoring if the axial thrust of the magnetic bearing spindle 12 is less than the sum of the allowable axial thrust and the lower dead band, the aforesaid Step S553 or Step S554 can be performed to control the thrust disk 122 to move toward the impeller 17 in the axial direction AD, such that the first clearance C1 is larger than the second clearance C2 (i.e., the clearance ratio of the first clearance C1 to the second clearance C2 is larger than 1). At the same time, benefited from the oblique structuring in the labyrinth seals 18, 19 which is able to reduce the labyrinth-seal clearances C5, C6, the axial thrust can be increased, but the gas leakage can be reduced, such that the efficiency of the magnetic bearing centrifugal compressor 1 can be promoted. Also, after the axial thrust has been increased and the gas leakage has been reduced by performing Step S553 or Step S554, as shown in FIG. 6A, the method goes back to node B for performing Step S53 to keep monitoring the axial thrust of the magnetic bearing spindle 12, measuring the first touchdown-bearing clearance C3 and the second touchdown-bearing clearance C4, and waiting for the next cyclic control time.

In summary, by providing the magnetic bearing centrifugal compressor and the controlling method thereof in this disclosure, the labyrinth seals and the corresponding magnetic bearing spindle and impeller, respectively, are paired into oblique arrangements in the axial direction, such that, through controlling the position of the thrust disk in the axial direction to adjust the labyrinth-seal clearances. Thereupon, the axial thrust can be adjusted, and the gas leakage can be controlled.

Further, the teeth portion of the conventional labyrinth seal is mainly a horizontal structure. Namely, the teeth portion of the labyrinth seal is parallel to the axial direction. In production, the conventional labyrinth seal is machined in the radial direction to form the horizontal teeth portion by appropriate machine tools. Generally speaking, the aforesaid manufacturing is comparatively difficult. Especially, if the clearance of the labyrinth ring for the conventional horizontal structure is demanded to be smaller, then the associated machining precision shall be increased, and the manufacturing difficulty would become much more severe. In addition, possibility of assembly interference or abnormal element contacts would be increased. Thereupon, it is inevitable that the assembling would be less easy, and the production cost would be raised. Further, at this time, the familiarity of technicians for assembling would be crucial. In comparison with the conventional horizontal structure for the teeth portion of the labyrinth seal (i.e., the teeth portion of the labyrinth seal is parallel to the axial direction), the teeth portion of the labyrinth seal in this embodiment is a tapered structure (i.e., the teeth portion of the labyrinth seal is not parallel to the axial direction), so that difficulties in both manufacturing and assembling the labyrinth seals can be reduced.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A magnetic bearing centrifugal compressor, comprising:

a magnetic bearing spindle, movable in an axial direction, including an axial thrust-reducing ring;

a thrust disk, sleeving fixedly the magnetic bearing spindle in a radial direction;

a front axial bearing and a rear axial bearing, disposed individually at two opposing sides of the thrust disk, wherein a first clearance exists between the rear axial bearing and the thrust disk in the axial direction, wherein a second clearance exists between the front axial bearing and the thrust disk in the axial direction;

an impeller, connected to a front end of the magnetic bearing spindle;

at least one labyrinth seal, pairing with the magnetic bearing spindle into an oblique arrangement with respect to the axial direction, each of the at least one labyrinth seal being spaced from the magnetic bearing spindle or the impeller by a labyrinth-seal clearance;

at least one touchdown bearing disposed by sleeving the magnetic bearing spindle without direct contact in the axial direction, wherein a first touchdown-bearing clearance and a second touchdown-bearing clearance exist at opposing sides of the at least one touchdown bearing in the axial direction, and a third touchdown-bearing clearance and a fourth touchdown-bearing clearance exist between the at least one touchdown bearing and the magnetic bearing spindle in the radial direction; and at least one radial bearing disposed by sleeving the magnetic bearing spindle without direct contact in the axial direction, wherein the at least one radial bearing is located between the at least one touchdown bearing and the thrust disk in the axial direction, and a first radial-bearing clearance and a second radial-bearing clearance exist between the at least one radial bearing and the magnetic bearing spindle in the radial direction;

wherein, by controlling a position of the thrust disk in the axial direction, a clearance ratio of the first clearance to the second clearance is varied to adjust the labyrinth-seal clearance;

wherein the first clearance is larger than the first touchdown-bearing clearance, the first clearance is larger than the second touchdown-bearing clearance, the second clearance is larger than the first touchdown-bearing clearance, and the second clearance is larger than the second touchdown-bearing clearance, such that a displacement of the magnetic bearing spindle in the axial direction is limited; and wherein the first clearance is larger than the first touchdown-bearing clearance, the first radial-bearing clearance is larger than the third touchdown-bearing clearance, the first radial-bearing clearance is larger than the fourth touchdown-bearing clearance, the second radial-bearing clearance is larger than the third touchdown-bearing clearance, and the second radial-bearing clearance is larger than the fourth touchdown-bearing clearance, such that another displacement of the magnetic bearing spindle in the radial direction is limited.

2. The magnetic bearing centrifugal compressor of claim 1, wherein, when the at least one labyrinth seal sleeves the impeller, the impeller has an oblique surface pairing with the at least one labyrinth seal into a corresponding oblique arrangement, the labyrinth-seal clearance exists between the oblique surface and the at least one labyrinth seal, and an angle between the oblique surface and the axial direction is smaller than or equal to 90 degrees.

3. The magnetic bearing centrifugal compressor of claim 1, wherein, when the at least one labyrinth seal sleeves the axial thrust-reducing ring, the axial thrust-reducing ring has an oblique surface pairing with the at least one labyrinth seal into a corresponding oblique arrangement, the labyrinth-seal clearance exists between the oblique surface and the at least one labyrinth seal, and an angle between the oblique surface and the axial direction is smaller than or equal to 90 degrees.

4. The magnetic bearing centrifugal compressor of claim 1, wherein the at least one labyrinth seal is formed as a diverging structure while viewed from the thrust disk.

5. The magnetic bearing centrifugal compressor of claim 1, further including a driving device for driving the magnetic bearing spindle.

6. The magnetic bearing centrifugal compressor of claim 5, wherein the driving device includes a motor rotor and a motor stator pairing, without contacting, the motor rotor, and both the motor rotor and the motor stator are arranged to circle the magnetic bearing spindle with the motor rotor being mounted at the magnetic bearing spindle.

7. A method for controlling a magnetic bearing centrifugal compressor, comprising the steps of:

(a) providing the magnetic bearing centrifugal compressor of claim 1;

(b) determining whether or not an axial thrust of the magnetic bearing spindle is within an allowable range; and (c) controlling a position of the thrust disk in the axial direction to adjust the labyrinth-seal clearance.

8. The method for controlling a magnetic bearing centrifugal compressor of claim 7, after the step (a), further including a step of setting parameters, including an allowable axial thrust, a minimal value of the first touchdown-bearing clearance, a minimal value of the second touchdown-bearing clearance, a maximal displacement allowance of clearance, an upper dead band, a lower dead band, a unit displacement of clearance control, and a cyclic control time.

9. The method for controlling a magnetic bearing centrifugal compressor of claim 8, wherein the step (b) includes a step (b1) of monitoring the axial thrust of the magnetic bearing spindle, measuring a first touchdown-bearing clearance and a second touchdown-bearing clearance, and waiting for the cyclic control time.

10. The method for controlling a magnetic bearing centrifugal compressor of claim 9, after the step (b1), further including the steps of:

(b11) determining whether or not the axial thrust is larger than a sum of the allowable axial thrust and the upper dead band; and (b12) if positive, further determining whether or not the first touchdown-bearing clearance is larger than the minimal value of the first touchdown-bearing clearance.

11. The method for controlling a magnetic bearing centrifugal compressor of claim 10, wherein the step (c) includes the steps of:

(c1) if a judgment in the step (b12) is positive, further determining whether or not the unit displacement of clearance control is larger than or equal to the maximal displacement allowance of clearance; and (c2) if positive, controlling a center of the magnetic bearing spindle to displace simultaneously the thrust disk in the axial direction toward the rear axial bearing by a distance equal to the maximal displacement allowance of clearance, so that the first touchdown-bearing clearance is reduced.

12. The method for controlling a magnetic bearing centrifugal compressor of claim 11, if a judgment in the step (c1) is negative, further including a step of controlling the center of the magnetic bearing spindle to displace simultaneously the thrust disk in the axial direction toward the rear axial bearing by a distance equal to the unit displacement of clearance control, so that the first touchdown-bearing clearance is reduced.

13. The method for controlling a magnetic bearing centrifugal compressor of claim 10, wherein, if a judgment in the step (b11) is negative, then perform the steps of:

(b13) determining whether or not the axial thrust is less than a sum of the allowable axial thrust and the lower dead band; and (b14) if positive, determining whether or not the second touchdown-bearing clearance is larger than the minimal value of the second touchdown-bearing clearance.

14. The method for controlling a magnetic bearing centrifugal compressor of claim 13, wherein the step (c) includes the steps of:

(c3) if a judgment in the step (b14) is positive, determining whether or not the unit displacement of clearance control is larger than or equal to the maximal displacement allowance of the clearance; and (c4) if positive, controlling the center of the magnetic bearing spindle to displace simultaneously the thrust disk in the axial direction toward the front axial bearing by a distance equal to the maximal displacement allowance of clearance, so that the second touchdown-bearing clearance is reduced.

15. The method for controlling a magnetic bearing centrifugal compressor of claim 14, wherein a judgment in the step (c3) is negative, then perform a step of controlling the center of the magnetic bearing spindle to displace simultaneously the thrust disk in the axial direction toward the front axial bearing by a distance equal to the unit displacement of clearance control, so that the second touchdown-bearing clearance is reduced.

* * * * *